US010830422B2

(12) United States Patent
Vartan

(10) Patent No.: US 10,830,422 B2
(45) Date of Patent: Nov. 10, 2020

(54) LIFE-LIGHT

(71) Applicant: Daniel R. Vartan, Kearny, NJ (US)

(72) Inventor: Daniel R. Vartan, Kearny, NJ (US)

( * ) Notice: Subject to any disclaimer, the term of this patent is extended or adjusted under 35 U.S.C. 154(b) by 51 days.

(21) Appl. No.: 16/158,339

(22) Filed: Oct. 12, 2018

(65) Prior Publication Data

US 2019/0113213 A1 Apr. 18, 2019

Related U.S. Application Data

(60) Provisional application No. 62/572,626, filed on Oct. 16, 2017.

(51) Int. Cl.

| | |
|---|---|
| ***F21V 21/14*** | (2006.01) |
| ***F21L 4/00*** | (2006.01) |
| ***F21V 21/08*** | (2006.01) |
| ***F21V 21/06*** | (2006.01) |
| ***F21V 21/26*** | (2006.01) |

(52) U.S. Cl.

CPC ..... *F21V 21/145* (2013.01); *F21L 4/00* (2013.01); *F21V 21/06* (2013.01); *F21V 21/08* (2013.01); *F21V 21/26* (2013.01)

(58) Field of Classification Search

CPC .. F21L 15/08; F21L 4/00; F21V 21/06; F21V 21/08; F21V 21/145

See application file for complete search history.

(56) References Cited

U.S. PATENT DOCUMENTS

| | | | | | |
|---|---|---|---|---|---|
| 2,237,536 | A * | 4/1941 | Wells, Jr. | E01F 9/688 | 340/321 |
| 2,706,610 | A * | 4/1955 | Roberts | F21V 21/06 | 248/168 |
| 3,876,970 | A * | 4/1975 | Schweitzer | F21L 4/00 | 362/205 |
| 4,208,703 | A * | 6/1980 | Orr | F16M 11/38 | 362/109 |
| 5,319,365 | A * | 6/1994 | Hillinger | B60Q 7/00 | 248/121 |
| 5,630,660 | A * | 5/1997 | Chen | B60Q 7/00 | 362/183 |
| 5,684,452 | A * | 11/1997 | Wang | B60Q 7/00 | 248/188.6 |
| 5,690,418 | A * | 11/1997 | Hsiung | G01C 15/008 | 362/259 |
| 6,873,249 | B2 * | 3/2005 | Chu | B60Q 7/00 | 116/63 P |

(Continued)

*Primary Examiner* — Leah Simone Macchiarolo
(74) *Attorney, Agent, or Firm* — Michael J. Foycik, Jr.

(57) ABSTRACT

A stable base supports a handle portion of an emergency light. The stable base has three legs which can be placed selectively in any of three configurations. In a first configuration, the legs are generally transverse to an axis of the emergency light handle, to form a tripod-like support on approximately level ground. In a second configuration, the legs are disposed downwardly so as to be generally parallel to the axis of the handle portion, such that the tips of the legs are disposed downward and are adapted to be inserted into the ground to resist high winds and gusts. In a third configuration, the legs are raised upward such that the tips of the legs are disposed adjacent to the handle portion of the emergency light, and are adapted to be inserted into a container for storage or shipping.

18 Claims, 9 Drawing Sheets

(56) References Cited

U.S. PATENT DOCUMENTS

| | | | | |
|---|---|---|---|---|
| 6,994,449 | B2 * | 2/2006 | Kim | F21L 4/005 362/110 |
| 7,063,444 | B2 * | 6/2006 | Lee | F21V 17/007 362/285 |
| 7,959,123 | B1 * | 6/2011 | Kitscha | F16M 11/041 248/168 |
| 8,087,797 | B2 * | 1/2012 | Pelletier | H05B 45/37 362/205 |
| 8,201,979 | B2 * | 6/2012 | Deighton | F16M 11/28 248/177.1 |
| 2009/0056153 | A1 * | 3/2009 | Tippett | G01C 15/00 33/228 |
| 2011/0228524 | A1 * | 9/2011 | Greer | F21L 4/00 362/190 |

* cited by examiner

LIFE-LIGHT

CROSS REFERENCE TO RELATED APPLICATIONS

This application claims the priority of Provisional Application No. 62/572,626 filed on Oct. 16, 2017, inventor Daniel R. Vartan, entitled "EMERGI-SAFE EMERGENCY LIGHT AND SYSTEM". The entire disclosure of this provisional patent application is hereby incorporated by reference thereto, in its entirety.

STATEMENT REGARDING FEDERALLY SPONSORED RESEARCH OR DEVELOPMENT

Not applicable.

FIELD OF THE INVENTION

The present invention relates to emergency lighting, warning lights, and portable flashlights.

BACKGROUND OF THE INVENTION

It is a problem in the art to provide a stable support for a portable battery operated, multi-function emergency light in the form of a flare, a flashlight, a signal light, a work light, and/or a lantern. It is also a problem in the art to provide a safer (no sparks, no flames, and no noxious smoke), reusable, more versatile, and user friendly alternative to the use of incendiary strike flares which only last a maximum of 30 minutes, having a stable base.

It is a further problem in the art to provide a stable base that can be configured to selectively be anchored in the ground using its three legs, so as to support a light of the type mentioned above, and also can be selectively placed above the ground supported by its three legs.

It is a further problem in the art to provide a foldable, reconfigurable device of the type described above, which is relatively easy to assemble and disassemble.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a support for a device for providing lighting and warning lights during an emergency, and for other uses as well.

The base supports the device for providing lighting. The device for providing lighting is a novel battery operated, multi-function LED emergency flare/flashlight/signal light/work light/lantern intended to be a safer (no sparks, no flames, and no noxious smoke), reusable, more versatile, and user friendly alternative to the use of incendiary strike flares which only last a maximum of 30 minutes versus this product's 60+ hours per set of batteries.

The invention is directed to a stable base and support for a portable battery operated, multi-function emergency light as described above which is in the form of a flare, a flashlight, a signal light, a work light, and/or a lantern. The stable base and support can be configured to selectively be anchored in the ground using its three legs, so as to support a light of the type mentioned above, and also can be selectively placed above the ground supported by its three legs.

The present invention additionally provides a foldable, reconfigurable stable base and support for the device of the type described above, which is relatively easy to assemble and disassemble.

A stable base supports a handle portion of an emergency light. The stable base has three legs which can be placed selectively in any of three configurations. In a first configuration, the legs are generally transverse to an axis of the emergency light handle, to form a tripod-like support on approximately level ground. In a second configuration, the legs are disposed downwardly so as to be generally parallel to an axis of the handle portion of the emergency light, and wherein the tips of the legs are disposed away from the handle portion of the emergency light, and are adapted to be inserted into the ground to form a strong immobile support to resist high winds and gusts. In a third configuration, the legs are raised so as to be disposed upwardly so as to be generally parallel to an axis of the handle portion of the emergency light, and wherein the tips of the legs are disposed adjacent to the handle portion of the emergency light, and are adapted to be inserted into a container for storage or shipping.

Other objects and advantages of the present invention will be more readily apparent from the following detailed description when read in conjunction with the accompanying drawings.

DETAILED DESCRIPTION OF THE INVENTION

Figure 1:
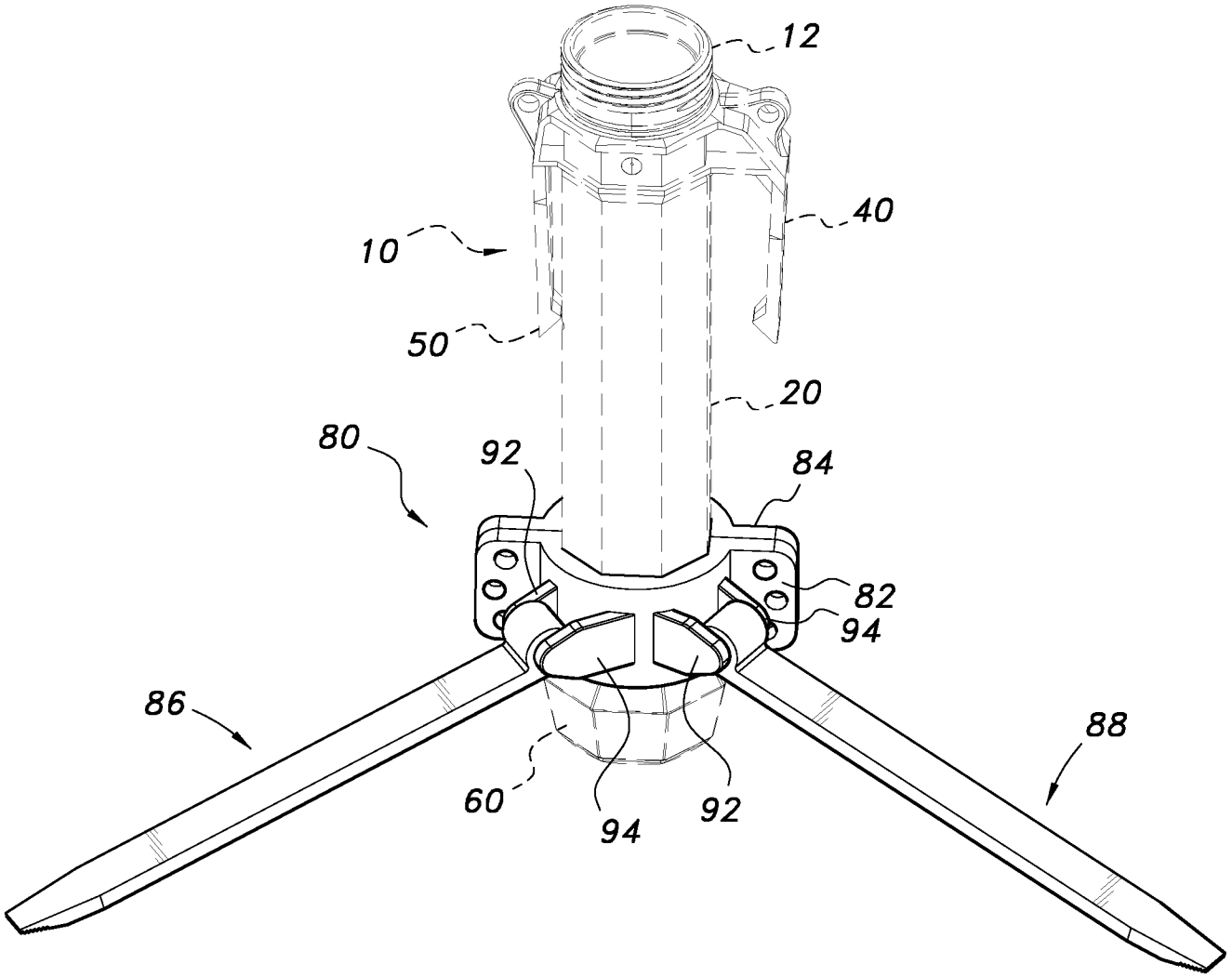
FIG. 1 is a perspective environmental view of a stable base and support for a device such as a handle portion of an emergency light which is shown in phantom outline, the stable base being in a first configuration with its legs outwardly directed, according to the present invention.

FIG. 1 is a perspective environmental view of a stable base and support 80 for a device 10 such as a handle portion of an emergency light which is shown in phantom outline. The stable base 80 has three legs 86, 88, and 90 (shown in FIG. 2). The stable base 80 is shown in a first configuration with its legs 86, 88, and 90 being outwardly directed.

The base 80 includes a first bracket 82 and a second bracket 84 which is preferably secured to the first bracket by bolts or screws (not shown). The brackets 82 and 84 can also be secured together by adhesive, ultrasonic welding, or welding, among other examples.

FIG. 1 shows a handle portion 10 of an emergency light according to the present invention. The emergency light will include a light emitting portion or lamp (shown in FIG. 10 as a payload P). The handle portion 10 includes a body portion 20 having an octagonal cross section such that it includes eight flat walls. The handle portion 10 includes an uppermost threaded portion 12, and includes a first arm 40 extending a specified distance from the body portion 20 and extending parallel thereto. The handle portion includes a second arm 50 closely spaced to the body portion 20 and likewise extending parallel to the body portion 20. The arms 40 and 50 are adapted to be used for hanging the handle portion 10 on any type of supports which are capable of being engaged by one of the arms 40 or 50.

Figure 10:
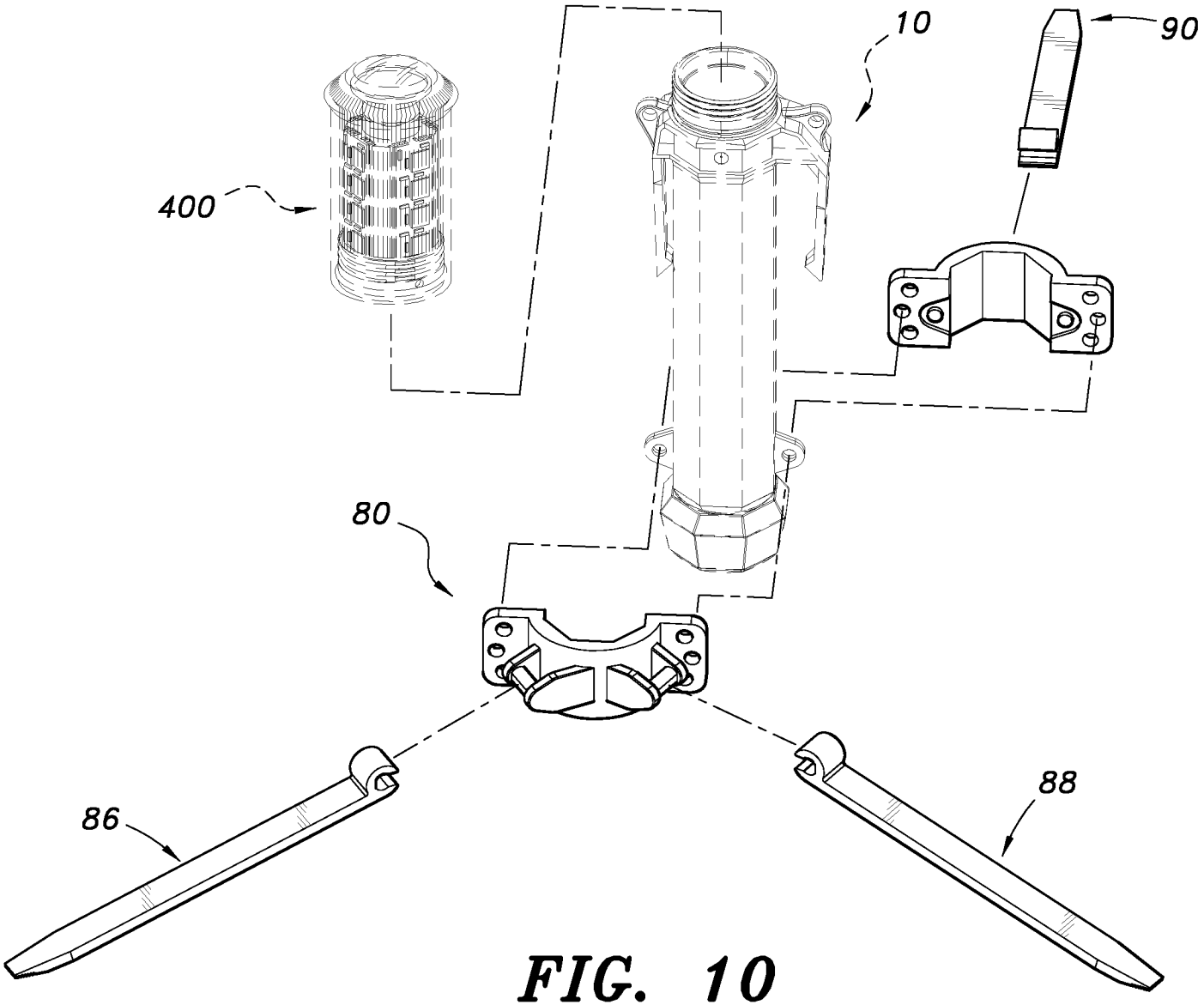
FIG. 10 is an exploded view of the invention shown in FIG. 5, and additionally showing a payload in solid outline supported by the handle portion of the emergency light, in which the payload can be a light-emitting lamp portion.

The emergency light as shown in FIG. 10, wherein the payload P is a light-emitting lamp, is preferably a battery operated, multi-function LED emergency flare/flashlight/signal light/work light/lantern which is a relatively safer (no sparks, no flames, and no noxious smoke), reusable, more versatile, and more user friendly alternative to the use of incendiary strike flares which only last a maximum of 30 minutes versus an LED emergency light having 60+ hours per set of batteries. Other types of light-emitting payloads P can be used, including any which would be known to any one having skill in the emergency light arts.

Figure 2:
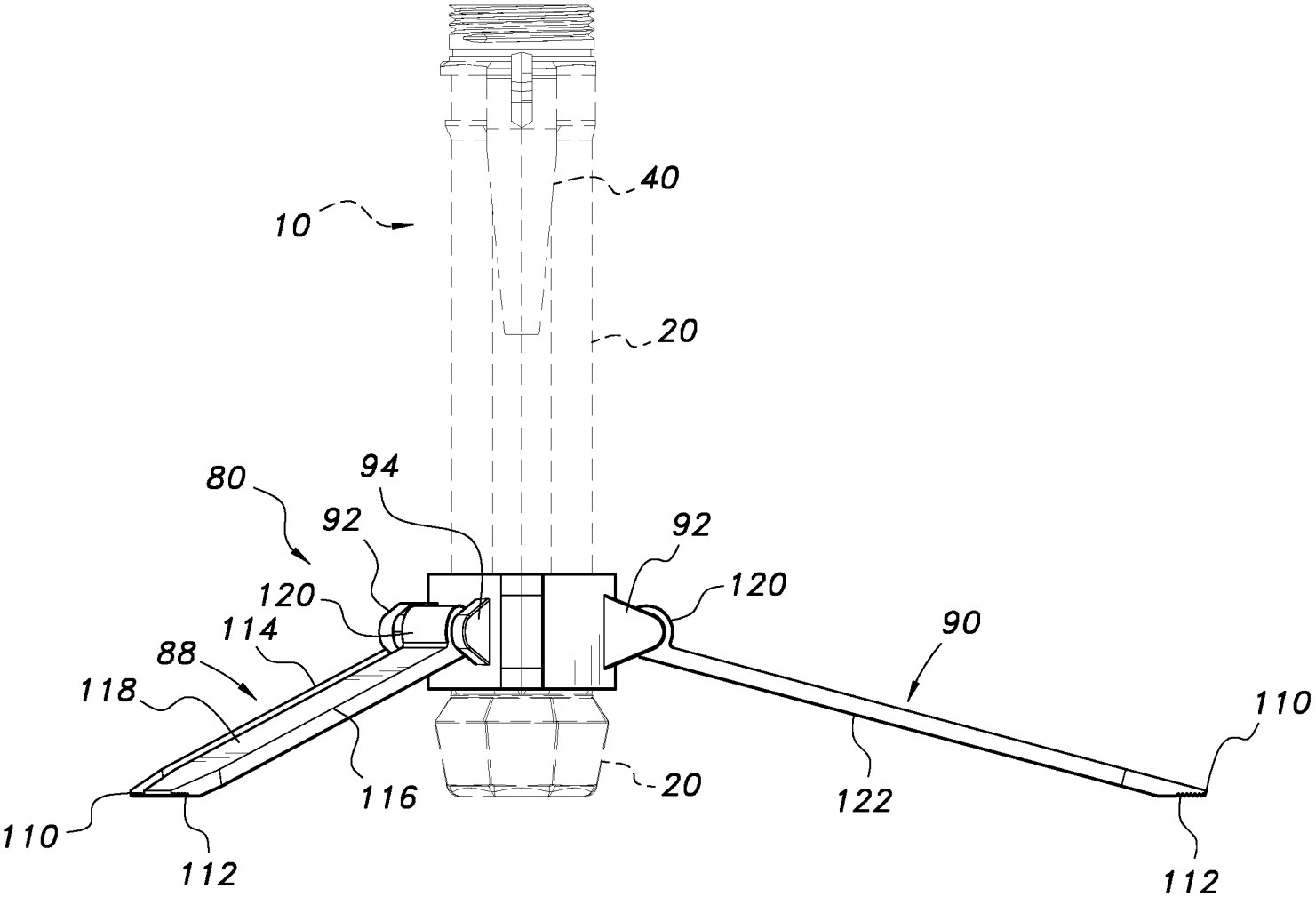
FIG. 2 is a side elevational environmental view as seen from the right of FIG. 1, showing the stable base and support of FIG. 1.

FIG. 2 is a side elevational environmental view as seen from the right of FIG. 1, showing the stable base and support 80 of FIG. 1. The leg 88 is typical of all three legs 86, 88, and 90, and has a flat portion 118 with opposed raised edges or lips 114 and 116. The leg 86 has a tip 110, and an underside 122. The end or tip 110 of the leg 86 is tapered (shown clearly with respect to the leg 90 in FIG. 2) to a point, and there are ridges on the underside 112 in the region of the tip 110.

The stable base 80 supports the handle portion 20 of the emergency light 10, having the three legs 86, 88, and 90 which can be placed selectively in any of three configurations. In a first configuration, the legs 86, 88, and 90 are generally transverse to an axis of the emergency light handle, to form a tripod-like support on approximately level ground. In a second configuration, the legs 86, 88, and 90 are disposed downwardly so as to be generally parallel to an axis of the handle portion 20 of the emergency light 10, and wherein the tips 110 of the legs 86, 88, and 90 are disposed away from the handle portion 20 of the emergency light 10, and are adapted to be inserted into the ground to form a strong immobile support to resist high winds and gusts. In a third configuration, the legs 86, 88, and 90 are raised so as to be disposed upwardly so as to be generally parallel to an axis of the handle portion 20 of the emergency light 10, and wherein the tips 110 of the legs 86, 88, and 90 are disposed adjacent to the handle portion 20 of the emergency light 10, and are adapted to be inserted into a container for storage or shipping.

Figure 3:
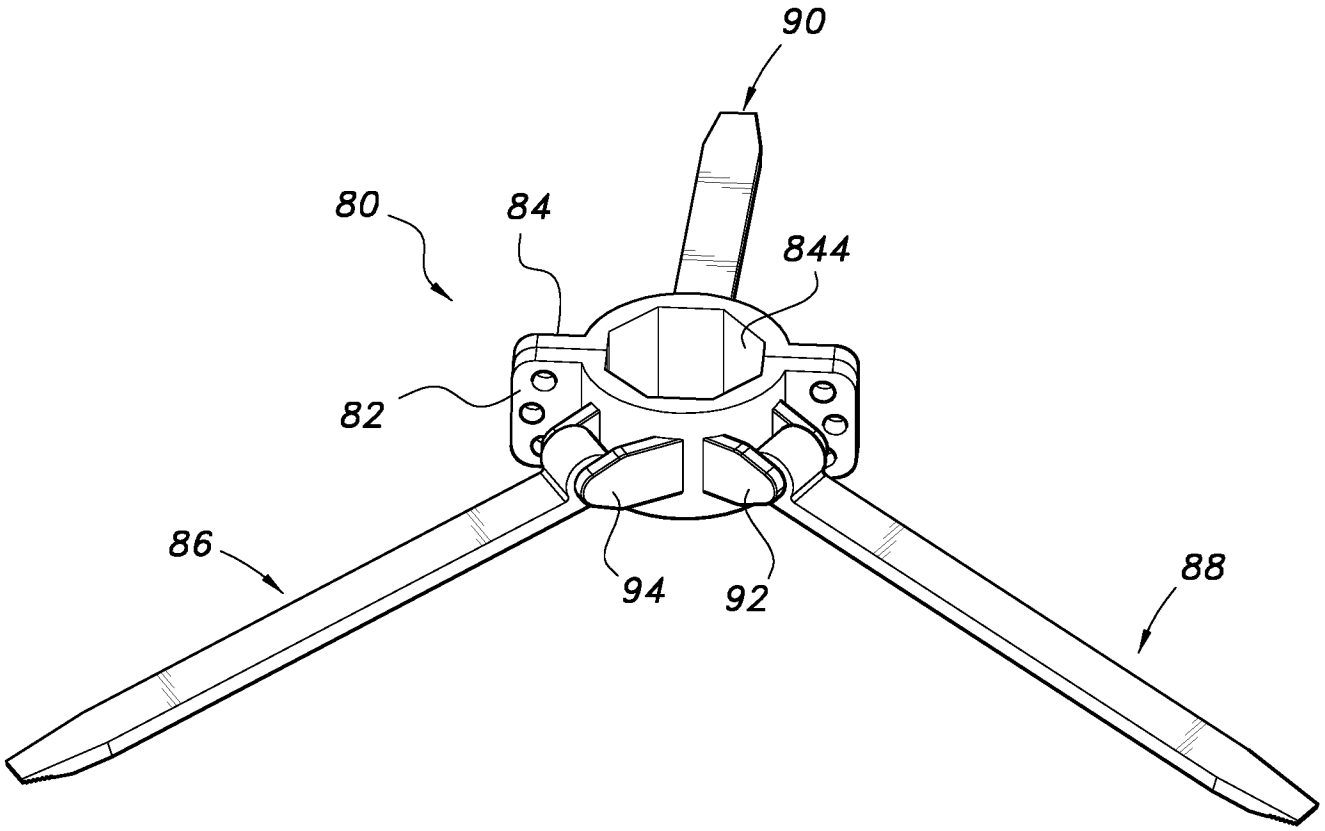
FIG. 3 is a perspective view of the stable base and support of FIG. 1.

FIG. 3 is a perspective view of the stable base and support 80 of FIG. 1.

Figure 4:
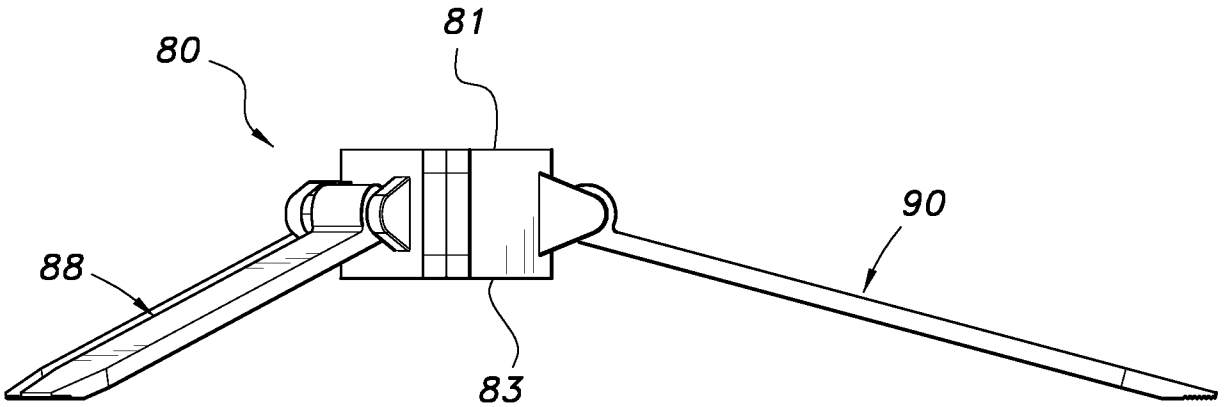
FIG. 4 is a side elevational view as seen from the right of FIG. 1, showing the stable base and support of FIG. 1.

FIG. 4 is a side elevational view as seen from the right of FIG. 1, showing the stable base and support 80 of FIG. 1.

Figure 5:
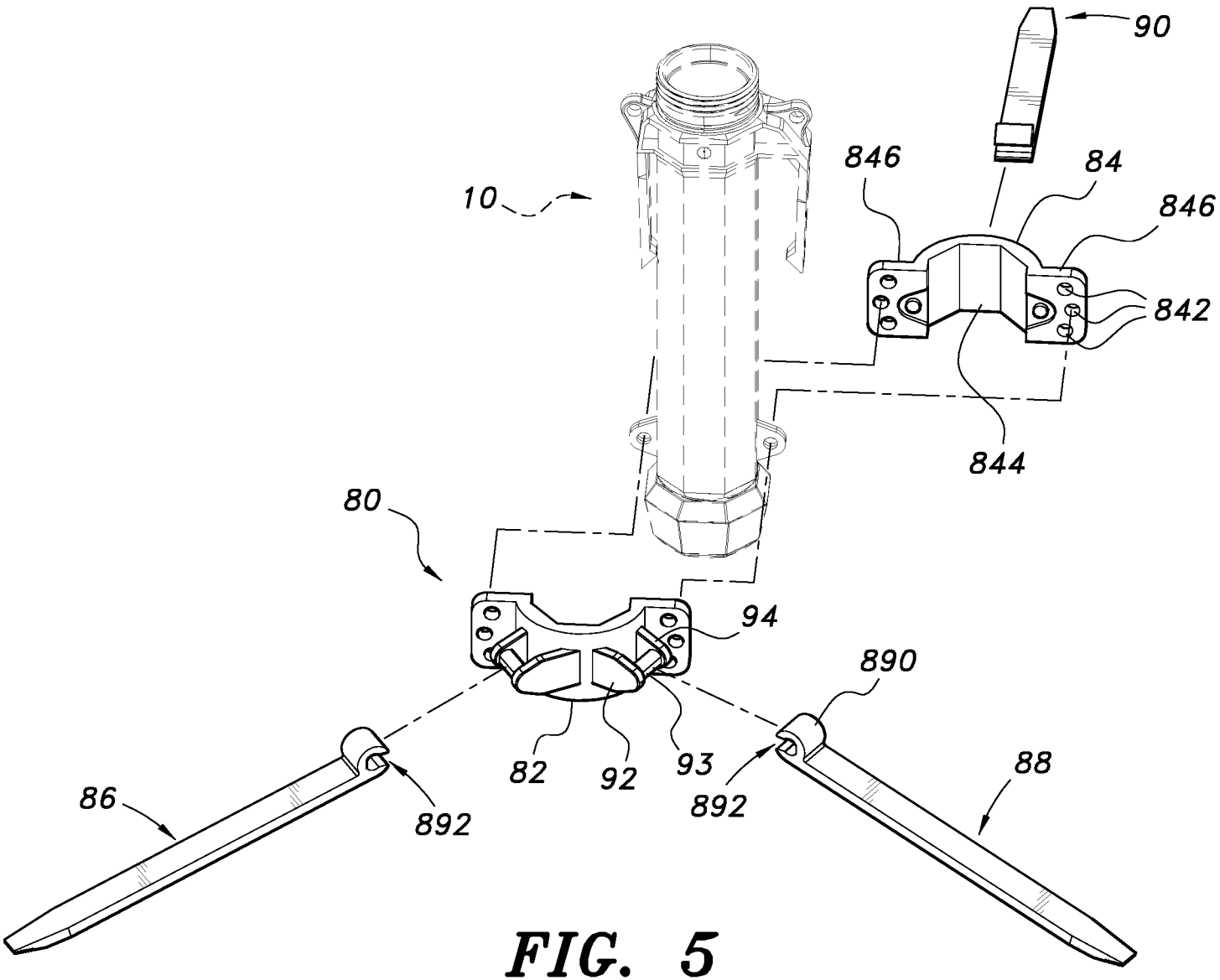
FIG. 5 is an exploded view of the invention, showing the stable base and support of FIG. 1 and showing the handle portion of the emergency light in phantom outline.

FIG. 5 is an exploded view of the invention, showing the stable base and support 80 of FIG. 1 and showing the handle portion 10 of the emergency light in phantom outline.

The bracket 82 has a first pair of tabs 92, 94 and a second pair of tabs 92, 94. The bracket 84 has a single pair of tabs 92, 94. As shown in FIG. 5, a support rod extends between each respective pair of tabs 92, 94. Each of the legs 86, 88, and 90 respectively includes a curved end 890 (shown by way of example for leg 88 in FIG. 5) having an open portion 892 adapted to receive a respective one of the rods 93, preferably by a snap fit engagement.

The curved portion 890 (shown as curved portion 120 in FIG. 2) are rounded, and can retain the respective leg in position due to frictional engagement with the adjacent surface of the respective bracket. Alternatively, the legs and be placed in the three configurations discussed herein by removal of the legs from the pins and reattachment of the legs to the pins after relocating the legs into the desired configuration.

The bracket 84 has an inner surface 844 having three flat portions for mating with the exterior of the handle portion 10, and the bracket 82 has substantially identical flat portions for mating with the exterior of the handle portion 10. The bracket 84 includes a pair of wing portions 846, 846, each of the wing portions 846 having three bores or holes 842 therethrough. The bracket 82 has a similar pair of wing portions (unnumbered in FIG. 5) and corresponding bores or holes (unnumbered in FIG. 5). The uppermost hole 842 and the lowermost hole 842 are preferably used for passage of bolts to secure the bracket 84 to the bracket 82. The middle bore or hole 842 is preferably used to secure one end of a strap, the strap having a second end for engagement with one of the holes (unnumbered) in the handle portion 10, the strap being used for manually carrying the base 80 and emergency light 10 of FIG. 1.

The leg 86 has a curved end 892 adapted to be mounted on the rod 93, such as by a snap fit, such that the leg 86 is pivotable about the rod 93. The Similarly, the leg 88 has a curved end 890, likewise pivotably supported by a respective one of the rods 93, and the leg 90 has a curved portion (unnumbered) which is likewise pivotably supported by a respective one of the rods 93. The tabs 92, 94 serve to support the rod 93.

Figure 6:
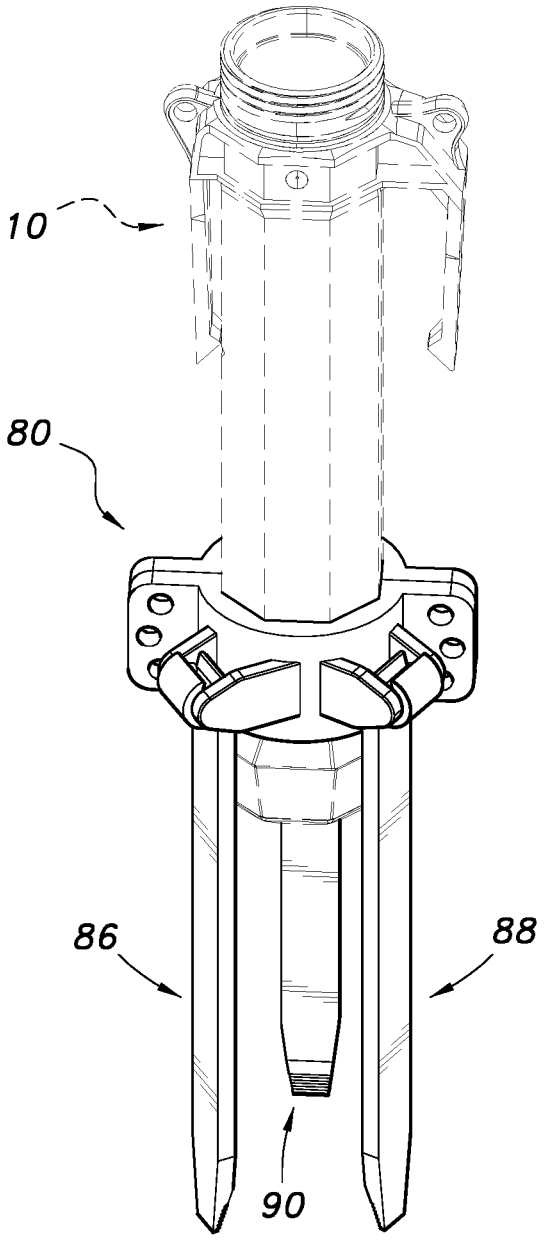
FIG. 6 is a perspective environmental view of the stable base and support of FIG. 1, the stable base being in a second configuration with its legs downwardly directed for insertion into the ground, according to the present invention.

FIG. 6 is a perspective environmental view of the stable base and support 80 of FIG. 1, the stable base 80 being in a second configuration with its legs 86, 88, and 90 being downwardly directed for insertion into the ground, according to the present invention.

Figure 7:
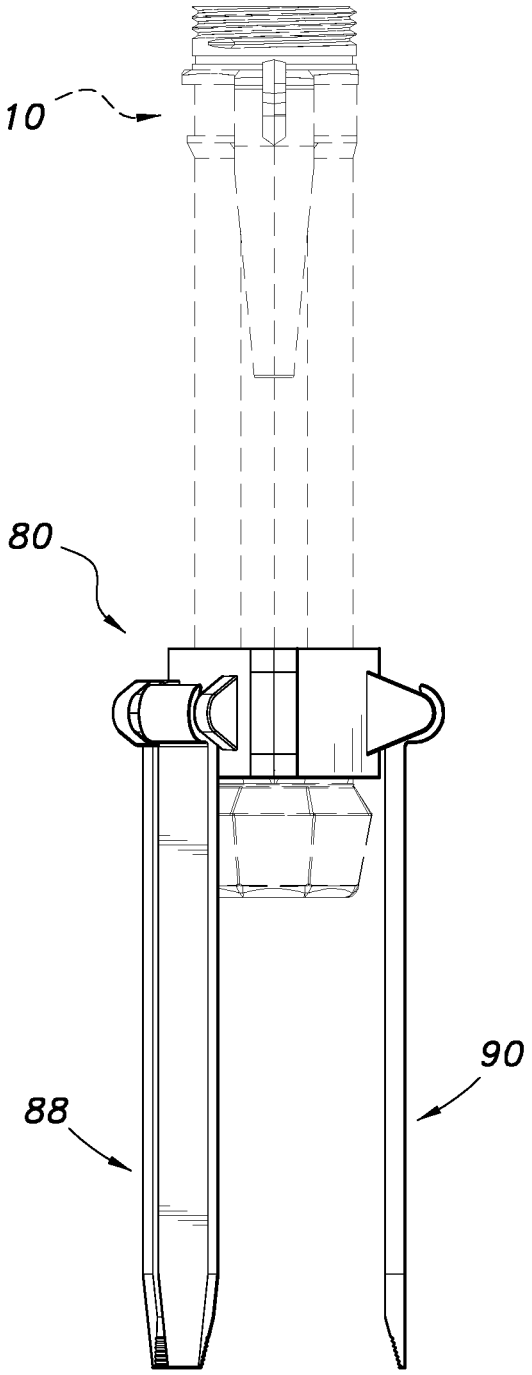
FIG. 7 is a side elevational environmental view as seen from the right of FIG. 6, showing the stable base and support of FIG. 1 in the second configuration.

FIG. 7 is a side elevational environmental view as seen from the right of FIG. 6, showing the stable base and support 80 of FIG. 1 in the second configuration.

Figure 8:
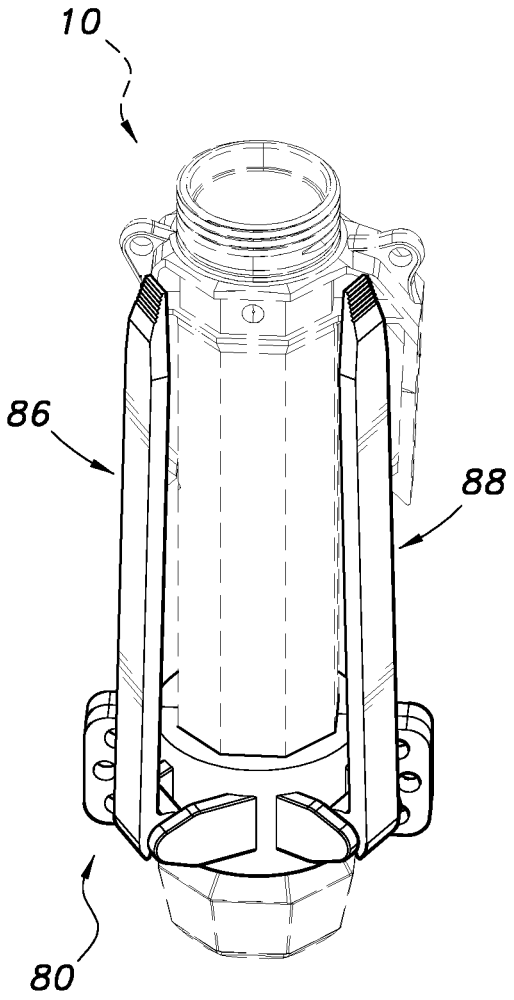
FIG. 8 is a perspective environmental view of a stable base and support for a device such as a handle portion of an emergency light which is shown in phantom outline, the stable base being in a third configuration with its legs upwardly directed such that they are adjacent the handle portion of the emergency light, the third configuration being adapted for storage and for ease of handling, according to the present invention.

FIG. 8 is a perspective environmental view of a stable base and support 80 for a device such as a handle portion of an emergency light 10 which is shown in phantom outline, the stable base 80 being in a third configuration with its legs 86, 88, 90 being upwardly directed such that they are adjacent the body portion 20 of the handle portion 10 of the emergency light, the third configuration being adapted for storage and for ease of handling, according to the present invention.

Figure 9:
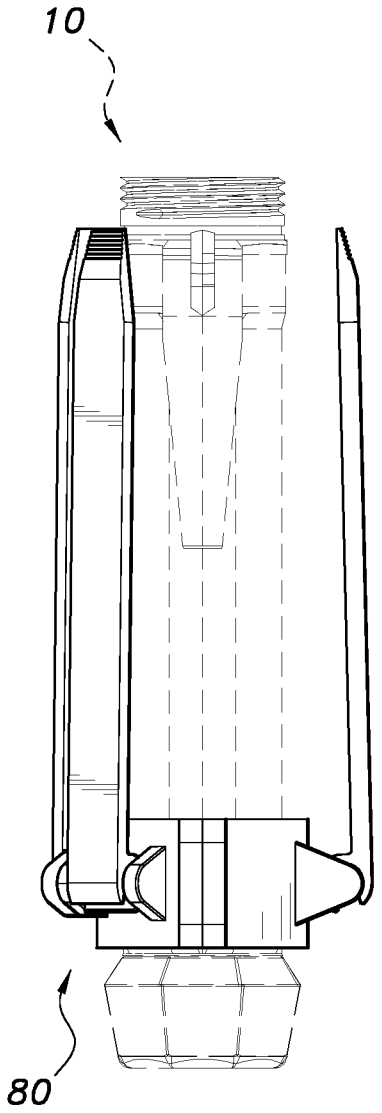
FIG. 9 is a side elevational environmental view as seen from the right of FIG. 8, showing the stable base and support of FIG. 1 in the third configuration.

FIG. 9 is a side elevational environmental view as seen from the right of FIG. 8, showing the stable base and support 80 of FIG. 1 in the third configuration.

FIG. 10 is an exploded view of the invention shown in FIG. 5, and additionally showing a payload P in solid outline supported by the uppermost threaded portion 12 of the handle portion 10 of the emergency light, in which the payload P can be a light-emitting lamp portion.

Figure 11:
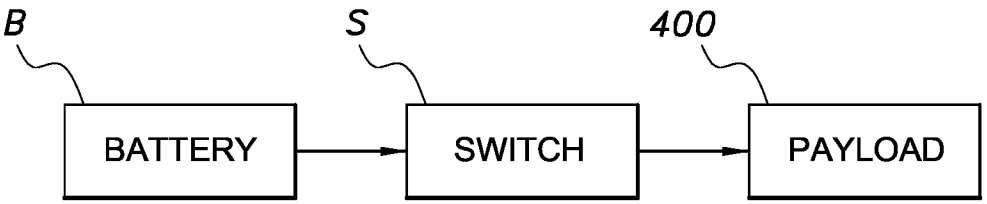
FIG. 11 is a schematic diagram of a circuit having a battery, switch, and the payload of FIG. 10, such that the battery is housed in the handle portion of the emergency light, and wherein the switch is mounted on the handle portion, so as to selectively power the payload which can be a light-emitting lamp portion.

FIG. 11 is a schematic diagram of a circuit having a battery B, a switch S, and the payload P of FIG. 10, such that the battery B is housed in the handle portion 10 of the emergency light, and wherein the switch S is mounted on the handle portion 10, so as to selectively power the payload P which can be a light-emitting lamp portion.

The payload P can be a transparent housing covering light-emitting LEDs, and wherein the top edge of the transparent housing preferably includes a lip (not shown). This lip can exist can have a structure extending outwardly, so that it can support or secure items usable with the emergency light such as a red cone so as to be able to use the light as a traffic wand by switching to the flashlight mode along with the red cone. And, the lip can be used to secure an additional battery powered light source, audible alarm, GPS, and/or other devices or items.

Figure 12:
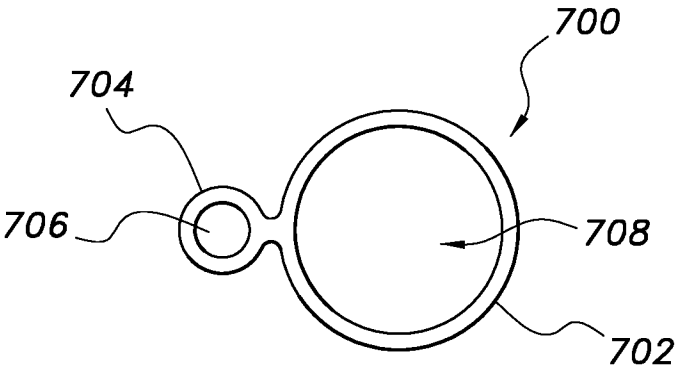
FIG. 12 is a top elevational view of a support member for attaching the handle portion of the emergency light to a traffic cone, the support member including a large loop portion attached to a small loop portion, wherein the large loop portion receives the tip of a traffic cone and the small loop portion receives an arm of the handle portion.

FIG. 12 is a top elevational view of a support member 700 for attaching the handle portion 10 of the emergency light to a traffic cone (not shown), the support member 700 including a large loop portion 702 attached to a small loop portion 704, wherein the large loop portion 702 receives the tip of a traffic cone (not shown) and the small loop portion 704 receives one of the arms 40 and 50 of the handle portion 10. The large loop portion 702 has an opening 708, and the small loop portion 704 has an opening 706. The support member 700 can be formed as a flat thin sheet, or it can have a cylindrical cross section such as a wire shape.

The emergency light of FIG. 10 preferably stands 12 inches tall in order to be seen over greater distances and varying terrain. Unlike other led flares on the market, this unit has an easily removed threaded lens for easy field replacement. The design of the lens allows for a tight fit against the parabolic reflector of the top mounted flashlight so as to prevent light scatter. An aluminum LED module under the lens is also removable for easy field replacement if it should be damaged or if the user would like to use a different led color module. This module can be changed out by simply removing the lens and a set screw which is located on the opposite side from the push button and just above the black O-ring.

The side facing led's (of the light-emitting portion of the payload P) can be single color or bi-color. There is also a 3 watt led on the top of the module along with a parabolic reflector to act as a powerful flashlight. The various functions of this product are operated through the use of a single push button located just below the clear lens.

The body portion 20 has an octagon shape to allow for a much more comfortable hand grip as well as to keep the unit from rolling if set down.

On the body portion 20, the clip 50 is close to the body and is used as a belt clip. The other clip, clip 40, is extended approximately one inch off the side of the body and has a primary purpose of being hooked through the hole at the top of a traffic cone should the user not want to use the optional traffic cone ring 700.

There are also four small body loops or bores, two upper and two lower, for the attachment of an optional shoulder strap or hand strap (not shown).

A battery cap (i.e., the bottom or top cover of the body portion 20) is also octagon shaped just as the body so as to help prevent rolling.

The present invention coves all variations in size and shape, that would be known to any one having skill in the flashlight arts.

The invention being thus described, it will be evident that the same may be varied in many ways by a routineer in the applicable arts. Such variations are not to be regarded as a departure from the spirit and scope of the invention and all such modifications are intended to be included within the scope of the invention.

What is claimed is:

1. A stable base for supporting a handle portion of an emergency light, the handle portion having a vertical axis, comprising:

a first bracket having at least two spaced pins;

a second bracket having at least one pin; said second bracket being adapted to connect to said first bracket to receive the handle portion of the emergency light;

a first leg having a connector portion pivotably connected to one of said at least two spaced pins of said first bracket;

a second leg having a connector portion pivotably connected to another one of said at least two spaced pins of said first bracket;

a third leg having a connector portion pivotably connected to said at least one pin of said second bracket;

said first, second, and third legs being selectively configurable in a first configuration to form a tripod-like support on a surface, a second configuration to penetrate into the ground, and a third configuration for compact storage.

2. A stable base as claimed in claim 1, wherein in said first configuration said first leg, said second leg, and said third leg are each disposed generally transversely to the axis of the handle portion.

3. A stable base as claimed in claim 1, wherein in said second configuration said first leg, said second leg, and said third leg are each disposed generally parallel to the axis of the handle portion, and extend downwardly away from the handle.

4. A stable base as claimed in claim 1, wherein in said third configuration said first leg, said second leg, and said third leg are each disposed generally parallel to the axis of the handle portion, and are disposed adjacent to the handle portion.

5. A stable base as claimed in claim 1, wherein said connector portion of said first leg is adapted to retain said first leg in said first configuration by frictional engagement with said first bracket.

6. A stable base as claimed in claim 1, further comprising a pair of ears extending from said first bracket to support one of said at least two pins.

7. A stable base in combination with an emergency light having a handle portion, the handle portion having a vertical axis, comprising:

a first bracket having at least two spaced pins;

a second bracket having at least one pin; said second bracket being adapted to connect to said first bracket to receive the handle portion of the emergency light;

a first leg having a connector portion pivotably connected to one of said at least two spaced pins of said first bracket;

a second leg having a connector portion pivotably connected to another one of said at least two spaced pins of said first bracket;

a third leg having a connector portion pivotably connected to said at least one pin of said second bracket;

said first, second, and third legs being selectively configurable in a first configuration to form a tripod-like support on a surface, a second configuration to penetrate into the ground, and a third configuration for compact storage.

8. A stable base as claimed in claim 7, wherein in said first configuration said first leg, said second leg, and said third leg are each disposed generally transversely to the axis of the handle portion.

9. A stable base as claimed in claim 7, wherein in said second configuration said first leg, said second leg, and said third leg are each disposed generally parallel to the axis of the handle portion, and extend downwardly away from the handle.

10. A stable base as claimed in claim 7, wherein in said third configuration said first leg, said second leg, and said third leg are each disposed generally parallel to the axis of the handle portion, and are disposed adjacent to the handle portion.

11. A stable base as claimed in claim 7, wherein said connector portion of said first leg is adapted to retain said first leg in said first configuration by frictional engagement with said first bracket.

12. A stable base as claimed in claim 7, further comprising a pair of ears extending from said first bracket to support one of said at least two pins.

13. A kit having an emergency light having a handle portion, a stable base for supporting the handle portion of the emergency light, and a loop connector for securing the emergency light to a traffic cone, the handle portion having a vertical axis and having an arm, comprising:

an emergency light having a light-emitting portion, and a handle portion having a power source;

a loop connector having a large loop adapted to receive a tip of a traffic cone, and a small loop adapted to receive the arm of said handle portion of said emergency light; and a stable base having:

a first bracket having at least two spaced pins;

a second bracket having at least one pin; said second bracket being adapted to connect to said first bracket to receive the handle portion of the emergency light;

a first leg having a connector portion pivotably connected to one of said at least two spaced pins of said first bracket;

a second leg having a connector portion pivotably connected to another one of said at least two spaced pins of said first bracket;

a third leg having a connector portion pivotably connected to said at least one pin of said second bracket;

said first, second, and third legs being selectively configurable in a first configuration to form a tripod-like support on a surface, a second configuration to penetrate into the ground, and a third configuration for compact storage.

14. A stable base as claimed in claim 13, wherein in said first configuration said first leg, said second leg, and said third leg are each disposed generally transversely to the axis of the handle portion.

15. A stable base as claimed in claim 13, wherein in said second configuration said first leg, said second leg, and said third leg are each disposed generally parallel to the axis of the handle portion, and extend downwardly away from the handle.

16. A stable base as claimed in claim 13, wherein in said third configuration said first leg, said second leg, and said third leg are each disposed generally parallel to the axis of the handle portion, and are disposed adjacent to the handle portion.

17. A stable base as claimed in claim 13, wherein said connector portion of said first leg is adapted to retain said first leg in said first configuration by frictional engagement with said first bracket.

18. A stable base as claimed in claim 13, further comprising a pair of ears extending from said first bracket to support one of said at least two pins.

* * * * *